United States Patent [19]

Johnson

[11] 4,177,793

[45] Dec. 11, 1979

[54] FREESTANDING FIREPLACE STOVE WITH HEATED AIR CIRCULATION

[75] Inventor: William R. Johnson, Santa Cruz, Calif.

[73] Assignee: Chinook Manufacturing Co., Santa Cruz, Calif.

[21] Appl. No.: 831,775

[22] Filed: Sep. 9, 1977

[51] Int. Cl.[2] ..... F24B 7/00

[52] U.S. Cl. .....126/121; 126/120

[58] Field of Search ..... 126/120, 121, 143, 130, 126/131, 135, 136, 140, 141, 142

[56] References Cited

U.S. PATENT DOCUMENTS

| | | | |
|---|---|---|---|
| 3,976,048 | 8/1976 | Ashman | 126/143 |
| 4,059,090 | 11/1977 | Shaw | 126/121 |
| 4,060,068 | 11/1977 | Lever et al. | 126/143 X |
| 4,074,679 | 2/1978 | Jensen | 126/131 X |

*Primary Examiner*—Dennis L. Taylor

*Attorney, Agent, or Firm*—Robert G. Slick

[57] ABSTRACT

A freestanding fireplace stove is provided with an air space surrounding the firebox with air circulation means for circulating air between the firebox and the outer walls of the fireplace. The air circulation may be forced.

1 Claim, 4 Drawing Figures

FREESTANDING FIREPLACE STOVE WITH HEATED AIR CIRCULATION

SUMMARY OF THE INVENTION

In my co-pending patent application Ser. No. 685,453 filed May 12, 1976, I described and claimed a freestanding fireplace stove wherein the combustion air passes under the bottom of the combustion chamber to keep the bottom of the fireplace unit cool. The claimed fireplace is so well insulated that it may be installed directly on a rug without the use of a hearth.

The present invention is an improvement over my prior structure in that a space or plenum is provided between the outer walls of the fireplace and the firebox with means for circulating air through the plenum. This results in much more efficient heating and utilizes more of the fuel burned so that less heat is lost up the chimney. The air flow may be by convection, but preferably a fan is employed.

By providing an air flow through the fireplace, better heat distribution is achieved within a room.

A further improvement of the present invention over my prior structure is that the firebox itself is made from welded stainless steel sections having stiffener channels thereon and it is not necessary to surround the firebox with insulating material, which further results in the better utilization of fuel.

Other objects and advantages of the invention will be described in the balance of the specification.

BRIEF DESCRIPTION OF THE DRAWINGS

In the drawings forming a part of this application.

DESCRIPTION OF THE PREFERRED EMBODIMENTS

Figure 1:
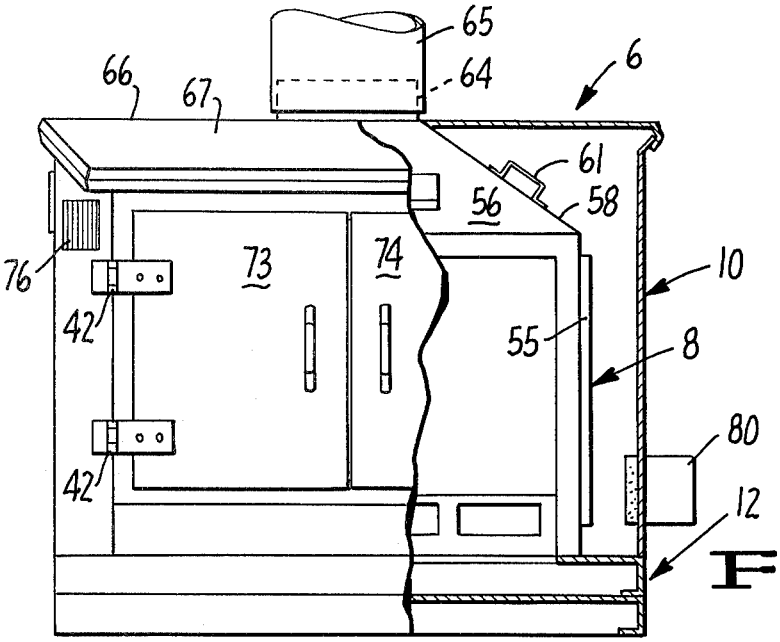
FIG. 1 is a front view of a fireplace embodying the present invention with certain of the parts cut away.

Referring now to the drawings by reference characters, the fireplace of the present invention includes four major parts, namely, the top 6, a firebox 8, an outer shell 10 and a base 12.

Figure 4:
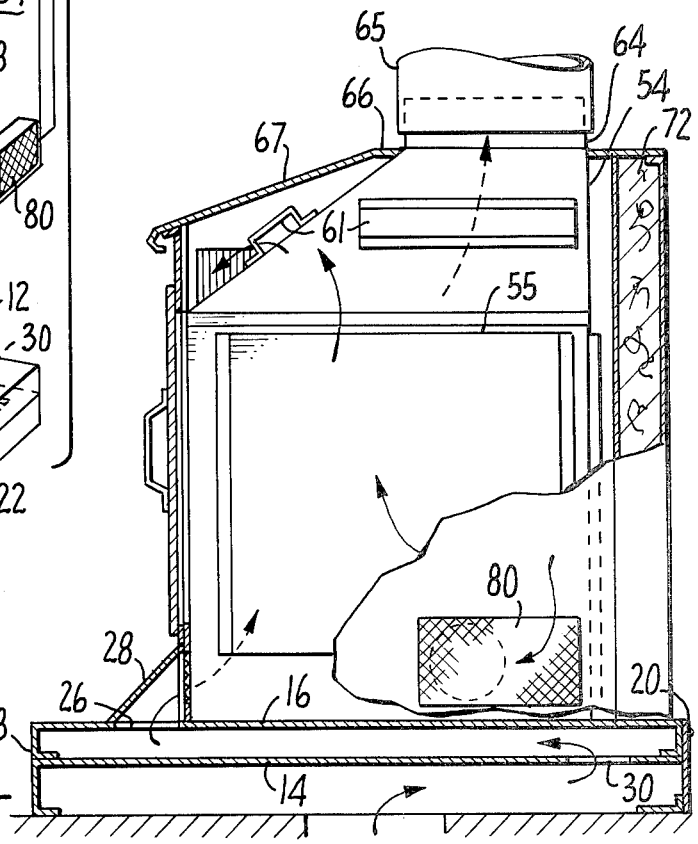
FIG. 4 is a side sectional view of the fireplace.

The base 12 is substantially like that of my prior patent and includes an intermediate plate 14, a top plate 16, front and back members 18 and 20, and side members 22 and 24. The top plate 16 has an opening 26 over which is the deflector assembly 28. The bottom of the base is open as can best be seen in FIG. 4 and combustion air flows into the bottom of the base, then toward the back under plate 14, and then upward through opening 30 in plate 14 where the air flows to the front of the fireplace. The combustion air then flows upward through opening 26 and is directed by deflector assembly 28 into the combustion zone of the firebox 8 through openings 48.

The outer shell 10 has a back wall 32, side walls 34 and 36, and angling front walls 38 and 40 which outline the sides of the mouth of the fireplace. These walls also support sockets 42 for the doors, later described. Located between the angling walls 38 and 40 are the front cross members 44 and 46 which, together with members 38 and 40, outline the mouth of the fireplace. The lower member 46 has openings 48 which mate with the deflector assembly 28 so that air is directed into the combustion zone when the fireplace is assembled.

The firebox itself, generally designated 8, is made of welded stainless steel and does not require insulation at the sides and back as in my previous structure. Thus, the firebox has side walls 50 and 52 and a back wall 54. The top is formed by the sloping members 56, 58 and 60 which mate with the top of back wall 54. At the top is the connection pipe 64 for connecting the firebox to the usual flue 65.

The top plate, generally designated as 6, has a flat rear portion 66 and a down sloping front portion 67. Plate 6 has downturned edges 68 adapted to mate with the top of the outer shell 10. Hole 70 is provided so that the pipe 64 can pass therethrough.

The back wall of the firebox is provided with a plurality of stiffening flanges 51 which are shaped somewhat like the letter Z and welded in place. Similar flanges 53 are provided on the side walls. Flanges 61 serve to stiffen members 56, 58 and 60. In addition, the side walls may have shields 55 which are mounted over the stiffening flanges. These shields are open at the top and bottom to permit air to circulate upwardly through them but they prevent the outer shell 10 from getting unduly hot from heat radiated by the firebox.

Figure 2:
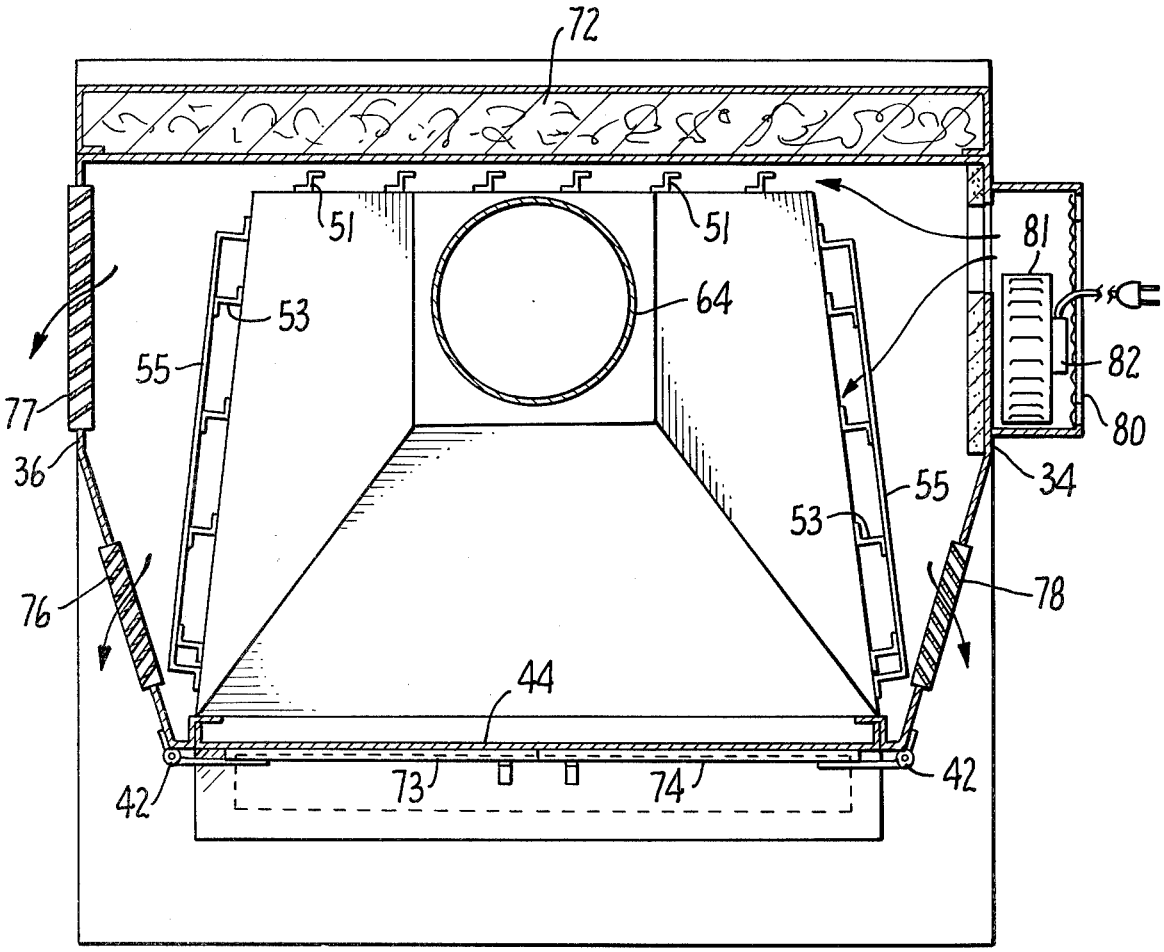
FIG. 2 is an enlarged top plan view of the fireplace, partly in section.
Figure 3:
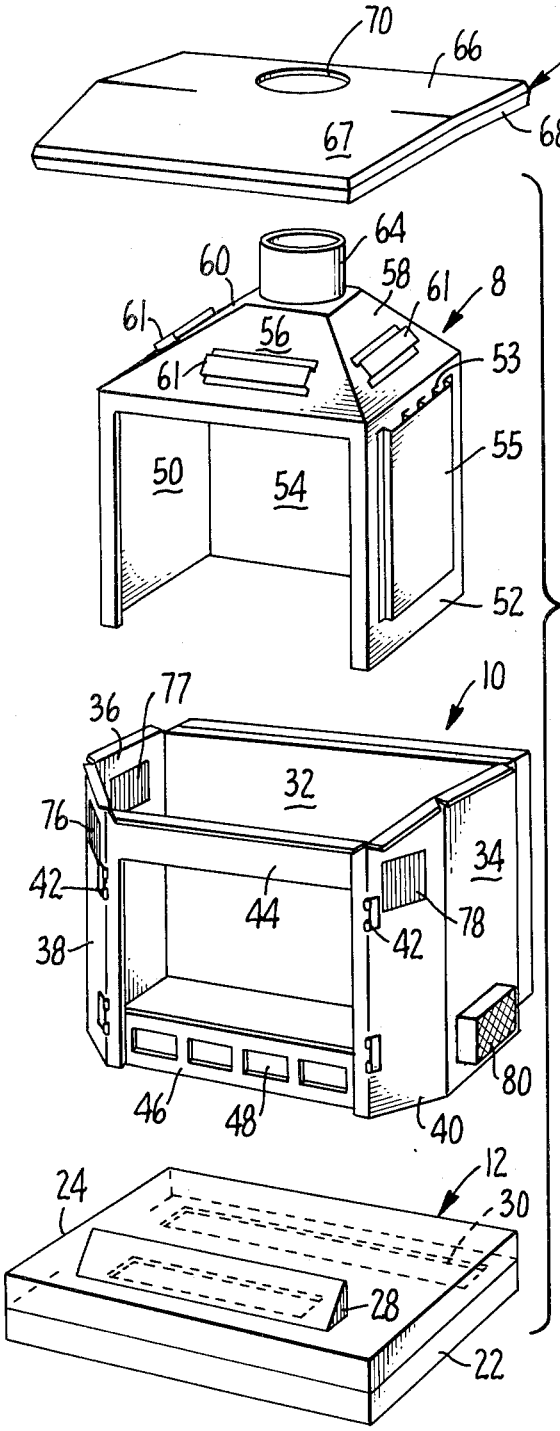
FIG. 3 is an exploded view of the parts comprising the fireplace of the present invention.

Insulation 72 is provided on the back wall of the outer shell so that the fireplace can be mounted directly against a wall. As can best be seen in FIG. 2, this insulation is placed a substantial distance from the firebox proper so that air can circulate along the back wall of the firebox.

Doors 73 and 74 are hinged on the outer shell 10. The firebox 8 fits tightly against the shell 10 at the front of the fireplace so there is no mixing of the combustion air and the air circulated in the plenum formed between the firebox and the outer shell.

In accordance with the present invention, an air circulation system is provided to achieve maximum efficiency from the fireplace. Air outlets are provided by the louvers 77, 76 and 78 near the top of the outer shell. Although three louvers have been shown, fewer or more might be employed and their location can be varied. Near the bottom of the outer shell is an air inlet 80 and this may be provided with a fan 81 driven by an electric motor 82. Preferably the fan and motor are located outside of shell 10 to prevent overheating. Thus when the fan is turned on, air is sucked through the opening 80 and discharged through the upper louvers so that the maximum amount of heat is extracted from the fuel which is burned. If desired, the fan may be omitted and the air will circulate by convection. It will be apparent that air can circulate freely in the plenum formed at the sides and rear of the firebox but not at the front.

It is believed apparent from the foregoing that I have provided an efficient air circulating fireplace which is particularly adapted for us in mobile homes and which can be installed in any position without providing a clearance space at the walls nor is it necessary to provide any insulation under the fireplace.

I claim:

1. A freestanding air circulating fireplace stove comprising, in combination:

a. an all metal uninsulated firebox having two side walls, a back wall and a top wall defining a combustion chamber having an open front, b. an outer shell completely surrounding said firebox and spaced therefrom to form plenum chambers between the sides, back and top of the firebox, said shell having a back wall including an insulation chamber, and insulation in said chamber so the fireplace stove can be mounted directly against a wall, and doors hingeably mounted thereon covering said firebox open front, said outer shell top being releasably connected to said firebox, c. a base for said firebox and outer shell, said base extending forwardly of the open front of said firebox and having a passage for combustion air from the base to the open front of the firebox, said passage having an air opening located in front of said hingeably mounted doors, said air opening forming the only passage for air into said firebox from said passage, said firebox having a plurality of openings mating with said air passage opening for receiving air therefrom, d. a flue for the exhaust of combustion products, said flue being in communication with the top wall of the firebox, e. a separate air inlet opening in said outer shell for admitting secondary air into the plenum between the outer shell and the sides, back and top of the firebox, f. exhaust air outlets in the outer shell g. an electric fan for circulating secondary air through said separate inlet opening, plenum and exhaust outlets, h. a plurality of Z-shaped stiffeners on said firebox sides and back, i. a pair of shields each mounted on one of said firebox sides by said stiffeners and spaced from said firebox sides to define air flow channels along said firebox sides, said shields extending only part of the way along said firebox sides to define entrance and exit areas near the top and bottom of said firebox sides respectively so that air from said separate inlet opening flows into said air flow channels to contact said firebox sides, and j. a plurality of channel defining means mounted on top of said firebox to receive air from said air flow channels and guide that air along the top of said firebox, said top mounted channel defining means being disposed essentially perpendicularly with respect to said firebox side channels.

* * * * *